US005477932A

United States Patent [19]

Asakura et al.

[11] Patent Number: 5,477,932

[45] Date of Patent: Dec. 26, 1995

[54] IMPACT DEVICE

[75] Inventors: Shigeki Asakura; Tokan Okawa, both of Toyohashi, Japan

[73] Assignee: Teisaku Corporation, Japan

[21] Appl. No.: 208,728

[22] Filed: Mar. 9, 1994

[30] Foreign Application Priority Data

Mar. 11, 1993 [JP] Japan ..... 5-079027

[51] Int. Cl.[6] ..... B25D 9/26; B25D 9/04

[52] U.S. Cl. ..... 173/16; 173/206; 92/6 R

[58] Field of Search ..... 91/519; 92/6 R; 173/15, 16, 17, 127, 135, 206, 208

[56] References Cited

U.S. PATENT DOCUMENTS

| | | | |
|---|---|---|---|
| 3,170,379 | 2/1965 | Dempster | 91/519 |
| 3,892,279 | 7/1975 | Amtsberg | 173/207 |
| 4,784,228 | 11/1988 | Ito | 173/208 |
| 4,817,737 | 4/1989 | Hamada et al. | 173/207 X |
| 4,951,757 | 8/1990 | Hamada et al. | 173/206 X |
| 5,134,989 | 8/1992 | Akahane | 173/206 X |

FOREIGN PATENT DOCUMENTS

| | | | |
|---|---|---|---|
| WO87/04216 | 7/1987 | WIPO . | |
| 0236721 | 9/1987 | WIPO . | |
| WO92/12323 | 7/1992 | WIPO | 173/206 |

*Primary Examiner*—Rinaldi I. Rada
*Assistant Examiner*—Jay A. Stelacone
*Attorney, Agent, or Firm*—Palmatier, Sjoquist & Helget

[57] ABSTRACT

An impact device includes a cylinder and a plunger which is received within the cylinder and movable in forward and rearward directions. The plunger includes a first and a second pressure receiving surface for receiving pressure of a pressurized fluid so as to apply force to the plunger in the forward and rearward directions, respectively. An additional pressure receiving surface is formed on the plunger for receiving the pressure from the pressurized fluid so as to apply force in the same direction as one of the first and second pressure receiving surfaces. A first control device is operable to selectively apply the pressure of the pressurized fluid to the additional pressure receiving surface.

10 Claims, 12 Drawing Sheets

IMPACT DEVICE

BACKGROUND OF THE INVENTION

1. Field of the Invention

The present invention relates to an impact device having an impact plunger operable by fluid pressure, and particularly to an impact device suitable for a hydraulic breaker or a rock drill for crushing a rock base.

2. Description of the Prior Art

Conventionally, an impact device is mounted on an arm of a construction machine such as a hydraulic excavator and is connected to a hydraulic pump which is normally provided on the construction machine, so that the impact device is driven by the hydraulic pump.

However, the amount of discharge of hydraulic fluid varies substantially with the capacity of the hydraulic pump provided on the construction machines such as hydraulic excavators. Thus, the performance of the impact device depends on the amount of discharge of hydraulic fluid from the hydraulic pump of the construction machine on which the impact device is mounted.

Further, pressure-receiving surfaces formed on a plunger of the conventional impact device for impact movement of the plunger have the same area with each other. Therefore, if the impact force is to be increased, the stroke of movement of the plunger must be determined to have a greater length, resulting in that the number of impacts is reduced. Furthermore, even if the amount of discharge of the hydraulic pump is larger than the amount of consumption of the hydraulic fluid in the impact device, the impact force cannot be increased since the capacity of the hydraulic pump cannot be fully utilized. Additionally, in this case, the excessive hydraulic fluid must be returned to a reservoir tank via a pressure control valve, etc., resulting in that the hydraulic fluid is heated or stained and that an excessive load is applied to the hydraulic pump. On the other hand, if the capacity of the hydraulic pump is too small as compared with the amount of possible consumption of the impact device, the operational pressure is reduced, resulting in that the performance of the impact device is degraded.

SUMMARY OF THE INVENTION

It is, accordingly, an object of the present invention to provide an impact device which is operable to increase the impact force without reducing the impact number.

It is another object of the present invention to provide an impact device which is operable to effectively utilize the capacity of the hydraulic pump.

According to the present invention, there is provided an impact device comprising:

a cylinder;

a plunger received within the cylinder and movable in forward and rearward directions, the plunger having a first and a second pressure receiving surface for receiving pressure of a pressurized fluid so as to apply force to the plunger in the forward and rearward directions, respectively;

the plunger having an additional pressure receiving surface for receiving the pressure from the pressurized fluid so as to apply force in the same direction as one of the first and second pressure receiving surfaces; and a first control device operable to selectively apply the pressure of the pressurized fluid to the additional pressure receiving surface.

With the present invention, according to the capacity of a supply source of the pressurized fluid such as a hydraulic pump, an operator can selectively apply the pressure of the pressurized fluid to the additional pressure receiving surface, so that the capacity of the supply source can be effectively utilized.

The invention will become more apparent from the appended claims and the description as it proceeds in connection with the drawings.

DETAILED DESCRIPTION OF THE PREFERRED EMBODIMENTS

Figure 1:
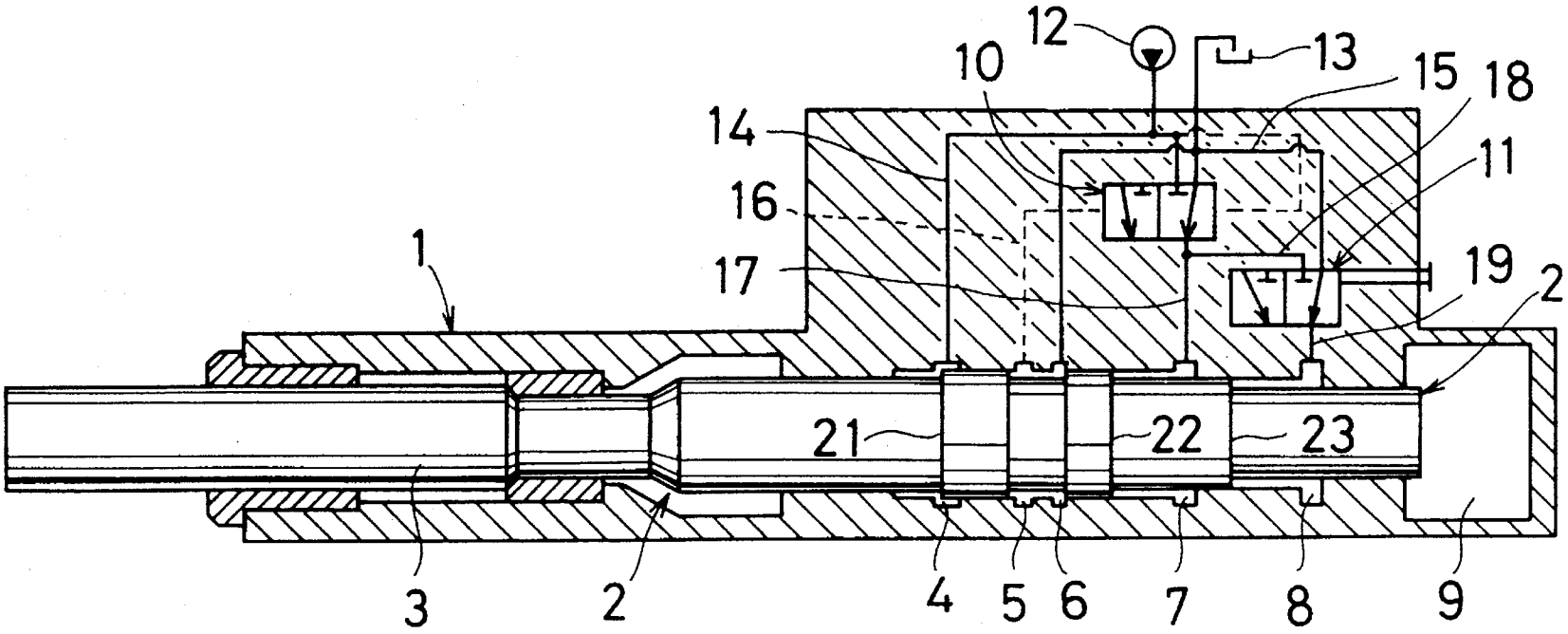
FIG. 1 is a vertical sectional view of an impact device according to a first embodiment of the present invention.

A first embodiment of the present invention will now be explained with reference to FIGS. 1 to 3.

An impact device constructed as a hydraulic breaker includes a cylinder i mounted on a forward portion of an arm (not shown) of a construction machine such as a hydraulic excavator. A plunger 2 is slidably inserted within the cylinder i and is movable in forward and rearward directions along an axis of the cylinder 1. A chisel 3 is axially slidably inserted within the forward end of the cylinder 1. The chisel 3 repeatedly receives impacts from the plunger 2 so as to crush a rock base or the like as will be explained later.

A high-pressure chamber 4, a pilot chamber 5, a low-pressure chamber 6, a first inverting-pressure chamber 7 and a second inverting-pressure chamber 8 each having an annular configuration are formed between the inner wall of the cylinder 1 and the plunger 2 and are in turn positioned in the rearward direction. A sealed gas chamber 9 is formed between the rear end of the plunger 2 and the rear portion of the cylinder 1.

Figure 2:
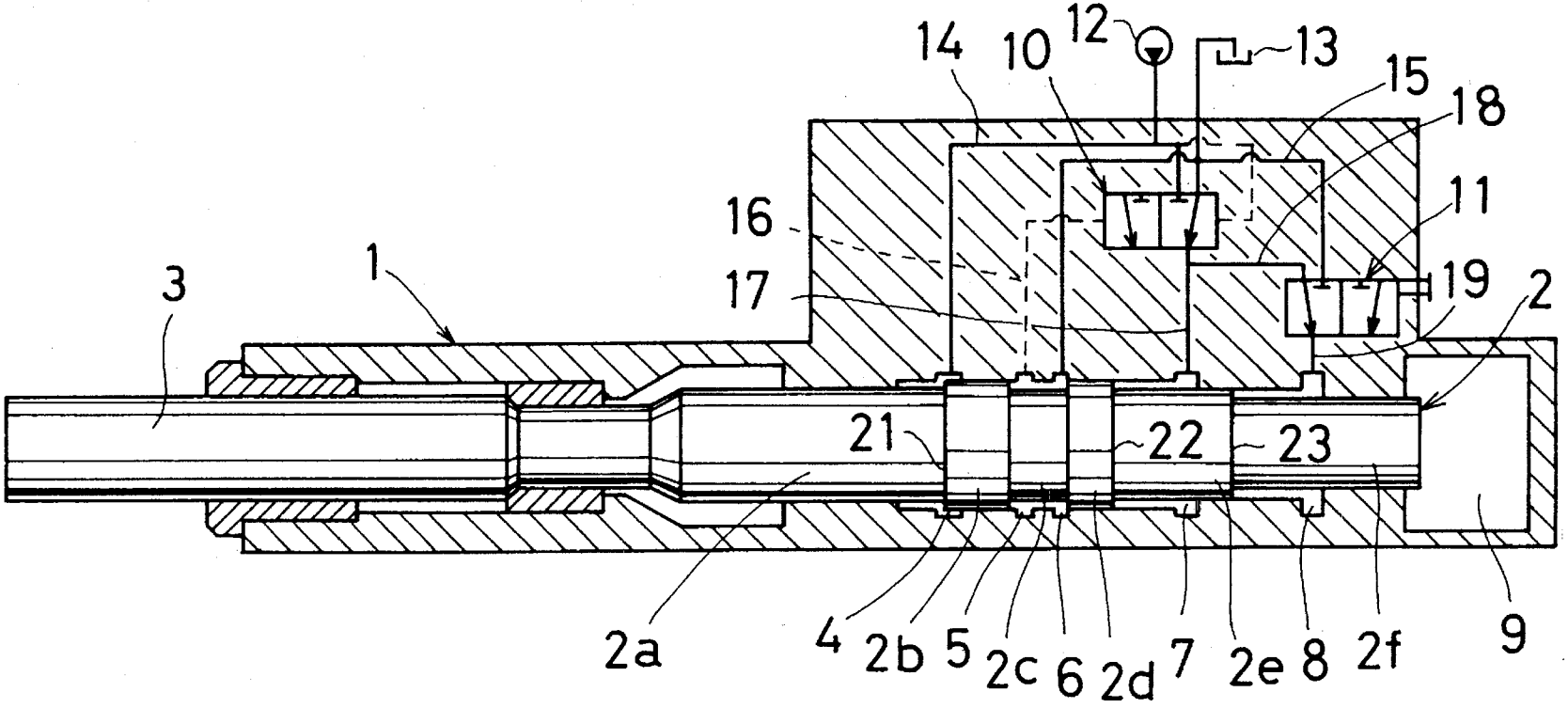
FIG. 2 is a view similar to FIG. 1 but showing the operation when the plunger is moved forwardly.
Figure 3:
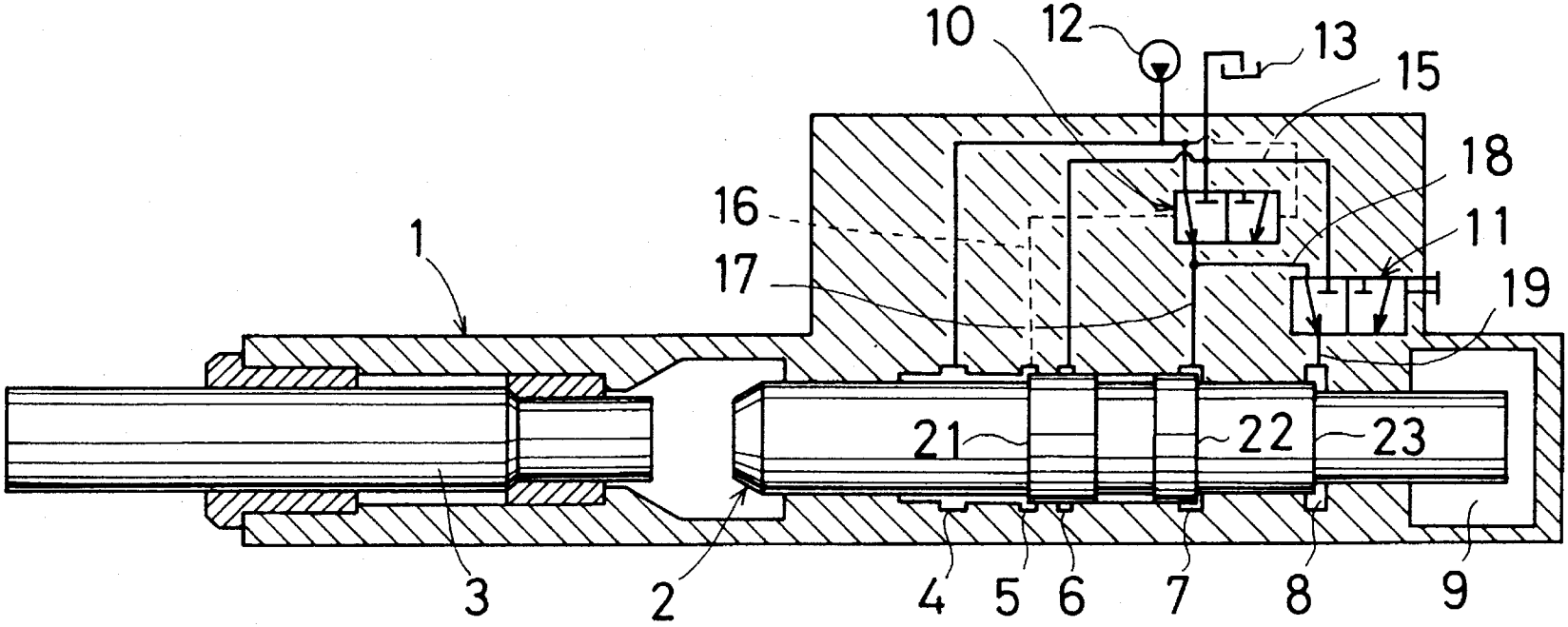
FIG. 3 is a view similar to FIG. 1 but showing the operation when the plunger is moved rearwardly.

As shown in FIG. 2, The plunger 2 includes a first intermediate-diameter portion 2*a*, a first large-diameter portion 2*b*, a second intermediate-diameter portion 2*c*, a second large-diameter portion 2*d*, a third intermediate-diameter portion 2*e* and a small-diameter portion 2*f* which are in turn positioned in the rearward direction. The first large-diameter portion 2*b* includes, at its forward end, a first pressure-receiving surface 21 on which the pressure of pressurized hydraulic fluid is applied for moving the plunger 2 in the rearward direction. The pressurized hydraulic fluid is supplied from a hydraulic pump 12 as will be explained later. The second large-diameter portion 2*d* includes, at its rear end, a second pressure-receiving surface 22 on which the pressure of the pressurized hydraulic fluid is applied for moving the plunger 2 in the forward direction. The area of the second pressure-receiving surface 22 is determined to be larger than the area of the first pressure-receiving surface 21. The third intermediate-diameter portion 2*e* includes, at its rear end, an additional pressure-receiving surface 23 on which the pressure of the presssurized hydraulic fluid is applied to move the plunger 2 in the forward direction.

A hydraulic control system of the impact device will now be explained.

A directional control valve 10 and a directional control valve 11 both of three-port/two-position type are mounted on the cylinder 1 for controlling the pressurized hydraulic fluid supplied from the hydraulic pump 12. The hydraulic pump 12 is provided on the construction machine on which the impact device is mounted.

The hydraulic pump 12 is connected to a high-pressure conduit 14 which is connected between a pump port of the directional control valve 10 and the high-pressure chamber 4. A reservoir tank 13 is connected to a low-pressure conduit 15 which connects the low-pressure chamber 6, a reservoir port of the directional control valve 10, and a reservoir port of the directional control valve 11 to each other. A pilot conduit 16 is connected between the directional control valve 10 and the pilot chamber 5 for operating a plunger (not shown) of the directional control valve 10. A first inverting-pressure conduit 17 is connected between the first inverting-pressure chamber 7 and a cylinder port of the directional control valve 10.

In response to the hydraulic pressure supplied from the pilot chamber 5, the directional control valve 10 is switched between two positions A1 and B1.

At position A1, the directional control valve 10 permits communication between the first inverting-pressure conduit 17 and the high-pressure conduit 14, while preventing communication between the first inverting-pressure conduit 17 and the low-pressure conduit 15.

At position B1, the directional control valve 10 permits communication between the first inverting-pressure conduit 17 and the low-pressure conduit 15, while preventing communication between the first inverting-pressure conduit 17 and the high-pressure conduit 14.

A second inverting-pressure conduit 18 is connected between the cylinder port of the directional control valve 10 and a pump port of the directional control valve 11. A change-over conduit 19 is connected between the second inverting-pressure chamber 8 and a cylinder port of the directional control valve 11. The directional control valve 11 is switched between two positions A2 and B2 through manual operation or through remote control.

At position A2, the directional control valve 11 permits communication between the first inverting-pressure conduit 17 and the second inverting-pressure chamber 8 through the second inverting-pressure conduit 18 and the change-over conduit 19, while preventing communication between the low-pressure conduit 15 and the change-over conduit 19 as shown in FIG. 2. Thus, the pressurized hydraulic fluid within the first inverting-pressure conduit 17 can be supplied to the second inverting-pressure chamber 8 so as to apply high pressure to the additional pressure-receiving surface 23.

At position B2, the directional control valve 11 permits communication between the low-pressure conduit 15 and the change-over conduit 19, while preventing communication between the first inverting-pressure conduit 17 and the second inverting-pressure chamber 8 as shown in FIG. 1. Thus, no pressurized hydraulic fluid is supplied to the second inverting-pressure chamber 8. Therefore, the second inverting-pressure chamber 8 is kept at low pressure and the additional pressure-receiving surface 23 no more receives high pressure.

In case that the impact device is to be driven by the hydraulic pump 12 having a smaller amount of discharge, the directional control valve 11 is positioned at position B2 as shown in FIG. 1 so as to prevent communication between the first inverting-pressure conduit 17 and the second inverting-pressure chamber 8. When the hydraulic pump 12 is started to be driven, the pressurized fluid is supplied from the hydraulic pump 12 to the high-pressure conduit 14 and subsequently to the high-pressure chamber 4, so that the plunger 2 is moved rearwardly. When the plunger 2 is moved a predetermined distance to reach the rearward stroke end, the high-pressure chamber 4 is connected to the pilot chamber 5 around the first intermediate portion 2*a* (see FIG. 3), so that the pressurized fluid is supplied from the pilot chamber 5 to the directional control valve 10 so as to switch the directional control valve 10 from position B1 to position A1. When this occurs, the pressurized fluid is also supplied to the first inverting-pressure chamber 7, so that the plunger 2 is moved forwardly because of the difference of the area between the first pressure-receiving surface 21 and the second pressure-receiving surface 22. Thus, the plunger 2 applies impact on the chisel 3.

When the plunger 2 is moved to its forward stroke end, the pilot chamber 5 is disconnected from the high-pressure chamber 4 and is connected to the low-pressure chamber 6 which is connected to the reservoir tank 13 via the low-pressure conduit 15, so that the pilot conduit 16 supplies the hydraulic fluid of low pressure to the directional control valve 10 to switch the same from position A1 to position B1. Then, the pressure within the first inverting-pressure chamber 7 is lowered through communication between the first inverting-pressure conduit 17 and the low-pressure conduit 15. Thus, the plunger 2 is again moved rearwardly because of the pressure difference between the high-pressure chamber 4 and the first inverting-pressure chamber 7.

The above operations are repeatedly performed to repeatedly apply impact on the chisel 3.

In case that the hydraulic pump 12 has a sufficient amount of discharge, the directional control valve 11 is switched to position A2 as shown in FIG. 2 so as to permit communication between the first inverting-pressure conduit 17 and the second inverting-pressure chamber 8 through the second inverting-pressure conduit 18 and the change-over conduit 19. When the plunger 2 is moved to reach the rearward stroke end, as shown in FIG. 3, the directional control valve 10 is switched to position A1 in the same manner as described above. Then, the pressurized hydraulic fluid is supplied to the second inverting-pressure chamber 8 as well as the first inverting-pressure chamber 7. The plunger 2 therefore receives, in the forward direction, a force corresponding to the difference between the first pressure-receiving surface 21 and the area of the additional pressure-receiving surface 23 in addition to the area of the second pressure-receiving surface 22. Thus, the plunger 2 applies a larger impact force to the chisel 3.

When the plunger 2 reaches the forward stroke end, the directional control valve 10 is switched to position B1, so that the second inverting-pressure conduit 18 as well as the first inverting-pressure conduit 17 is connected to the low-pressure conduit 15, so that the pressure within the second inverting-pressure chamber 8 as well as the first inverting-pressure chamber 7 is lowered. Then, the plunger 2 is moved rearwardly by the difference between the force applied to the first pressure-receiving surface 21 and the force applied to the second pressure-receiving surface 22 and the additional pressure-receiving surface 23.

As described above, by switching the directional control valve 11 to position A2, the plunger 2 can apply, to the chisel 3, the impact force which corresponds to the force in combination of the forces applied to the second pressure-receiving surface 22 and the additional pressure-receiving surface 23.

Thus, with the impact device of this embodiment, the directional control valve 11 is operable to permit and prevent supply of the pressurized hydraulic fluid to the second inverting-pressure chamber 8 for applying the pressure to the additional pressure-receiving surface 23.

Therefore, if the hydraulic pump 12 has a sufficient amount of discharge, the directional control valve 11 is switched to position A2, so that the plunger 2 can receive a larger impact force which corresponds to the force applied to the additional pressure-receiving surface 23 in addition to the force applied to the second pressure-receiving surface 22. Therefore, the discharge capacity of the hydraulic pump 12 can be effectively utilized, and the breaking ability of the impact device can be improved when the impact device is operated to break the rock bed or the like.

Further, if the amount of discharge of the hydraulic pump 12 too small, the directional control valve 11 is switched to position B2 so as not to apply force to the additional pressure-receiving surface 23.

Second to eighth embodiments will now be described with reference to FIGS. 4 to 12(A) and 12(B). These embodiments are modifications of the first embodiment, and therefore, the explanation of the same parts as the first embodiment is omitted by affixing, to the drawings, the same numerals as the first embodiment.

Figure 4:
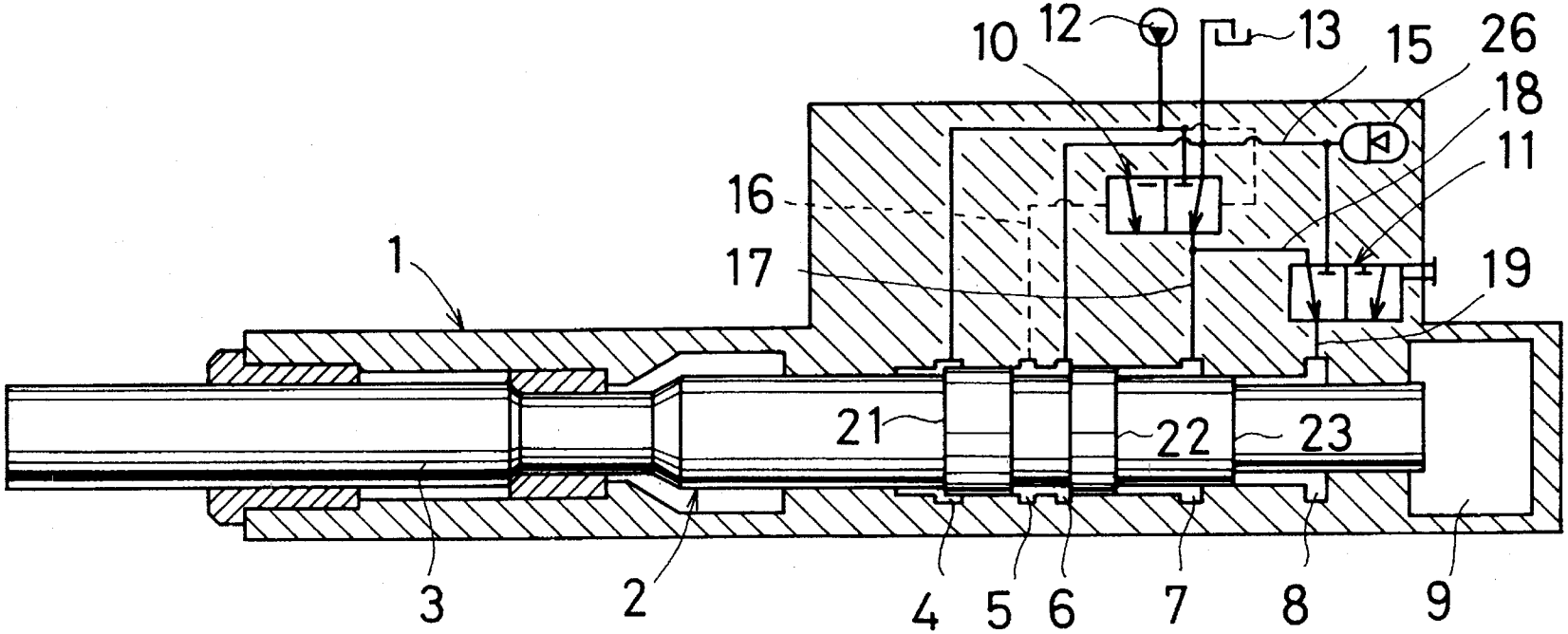
FIG. 4 is a vertical sectional view of an impact device according to a second embodiment of the present invention.

The second embodiment of the present invention will now be described with reference to FIG. 4. The second embodiment is different from the first embodiment in the provision of an accumulator 26 which is connected to the low-pressure conduit 15. In other respects, the second embodiment is the same as the first embodiment.

On the condition that the directional control valve 11 is switched to position A2, when the plunger 2 is moved rearwardly, the hydraulic fluid of low pressure is returned from the first and second inverting-pressure chambers 7 and 8 to the reservoir tank 13 through the low-pressure conduit 15. With such movement of the hydraulic fluid, pulsation may be produced in the hydraulic fluid in some cases. However, such pulsation is absorbed and reduced by the accumulator 26. Further, On the condition that the directional control valve 11 is switched to position B2, when the plunger 2 is moved forwardly, the hydraulic fluid stored in the reservoir tank 13 may cause counterflow to the second inverting-pressure chamber 8. However, with this embodiment, no counterflow may be caused because of the pressure of fluid stored in the accumulator 26.

Figure 5:
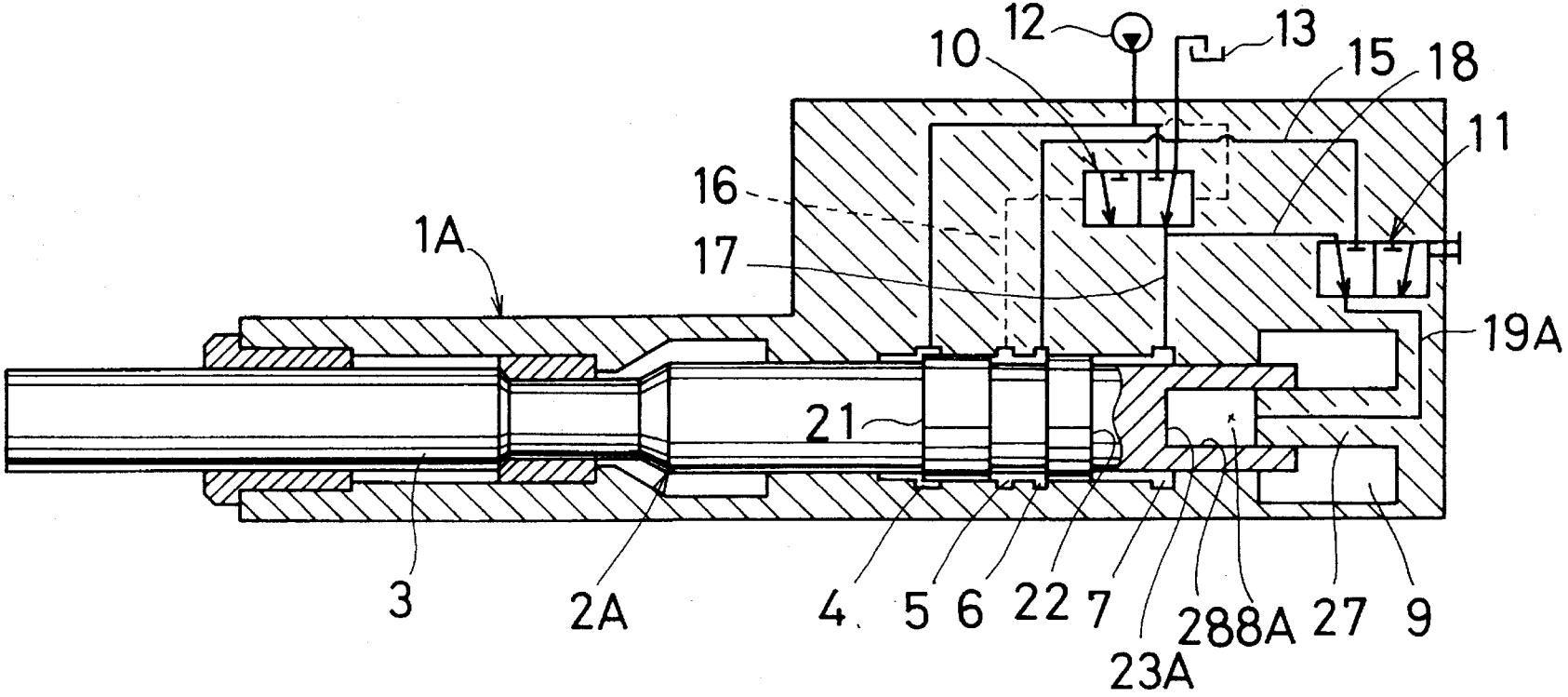
FIG. 5 is a vertical sectional view of an impact device according to a third embodiment of the present invention.
Figure 6:
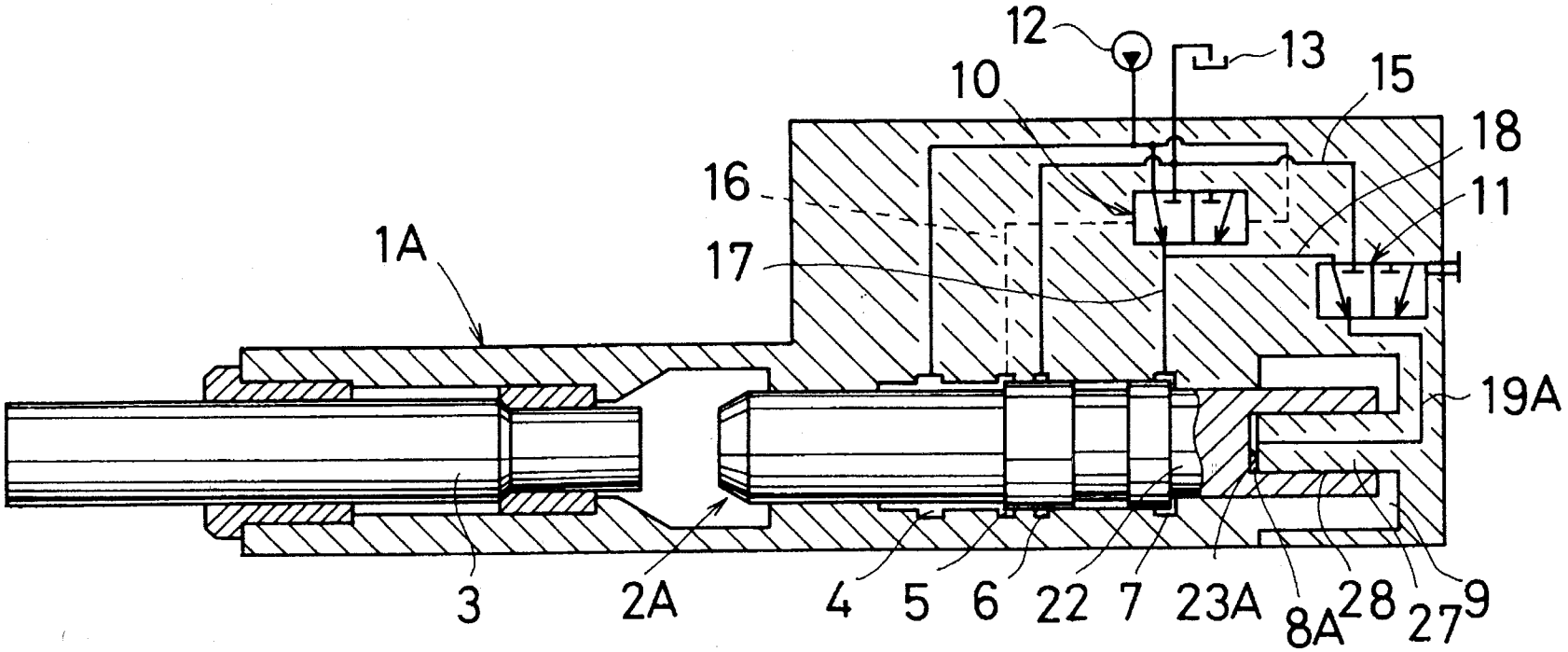
FIG. 6 is a view similar to FIG. 5 but showing the operation when the plunger is moved rearwardly.

The third embodiment of the present invention will now be described with reference to FIGS. 5 and 6.

In this embodiment, a cylindrical protrusion 27 is formed integrally with the rear portion of a cylinder 1A and extends within the sealed gas chamber 9. The protrusion 27 are positioned coaxially with a plunger 2A and protrudes toward the plunger 2A. An axial bore 28 is formed on the rear end of the plunger 2A and sealingly receives the protrusion 27.

A change-over conduit 19A is provided for connection between the cylinder port of the directional control valve 11 and a second inverting-pressure chamber 8A formed within the bore 28 and has a capacity which varies in response to movement of the plunger 2A. An additional pressure-receiving surface 23A is formed on the bottom of the bore 28. When the pressurized hydraulic fluid is supplied to the second inverting-pressure chamber 8A, the additional pressure-receiving surface 23A receives the pressure from the hydraulic fluid so as to apply force to the plunger 2A in the forward direction.

Thus, with this embodiment, when the directional control valve 11 is switched to position A2, the pressurized hydraulic fluid is supplied to the first inverting-pressure chamber 7 through the first inverting-pressure conduit 17. At the same time therewith, the hydraulic fluid is also supplied to the second inverting-pressure chamber 8A through the second inverting-pressure conduit 18 and the change-over conduit 19A. Therefore, the pressure of the pressurized hydraulic fluid is applied to the additional pressure-receiving surface 23A as well as the second pressure-receiving surface 22, so that the plunger 2A can apply the impact force corresponding to the force applied to the additional pressure-receiving surface 23A in addition to the force applied to the second pressure-receiving surface 22.

The fourth embodiment of the present invention will now be explained with reference to FIG. 7. In this embodiment, a directional control valve 11B of four-port/two-position type is provided in place of the directional control valve 11 of the first embodiment. The directional control valve 11B is connected in the midway of a first inverting-pressure conduit 17B which connects the directional control valve 10 to the first inverting-pressure chamber 7, so that the second inverting-pressure conduit 18 required in the first embodiment is omitted. Further, in this embodiment, the ratio of the area of the second pressure-receiving surface 22 to the area of the additional pressure-receiving surface 23 is determined to 1:2.

The directional control valve 11B is operable to be switched between positions A3 and B3.

Figure 7:
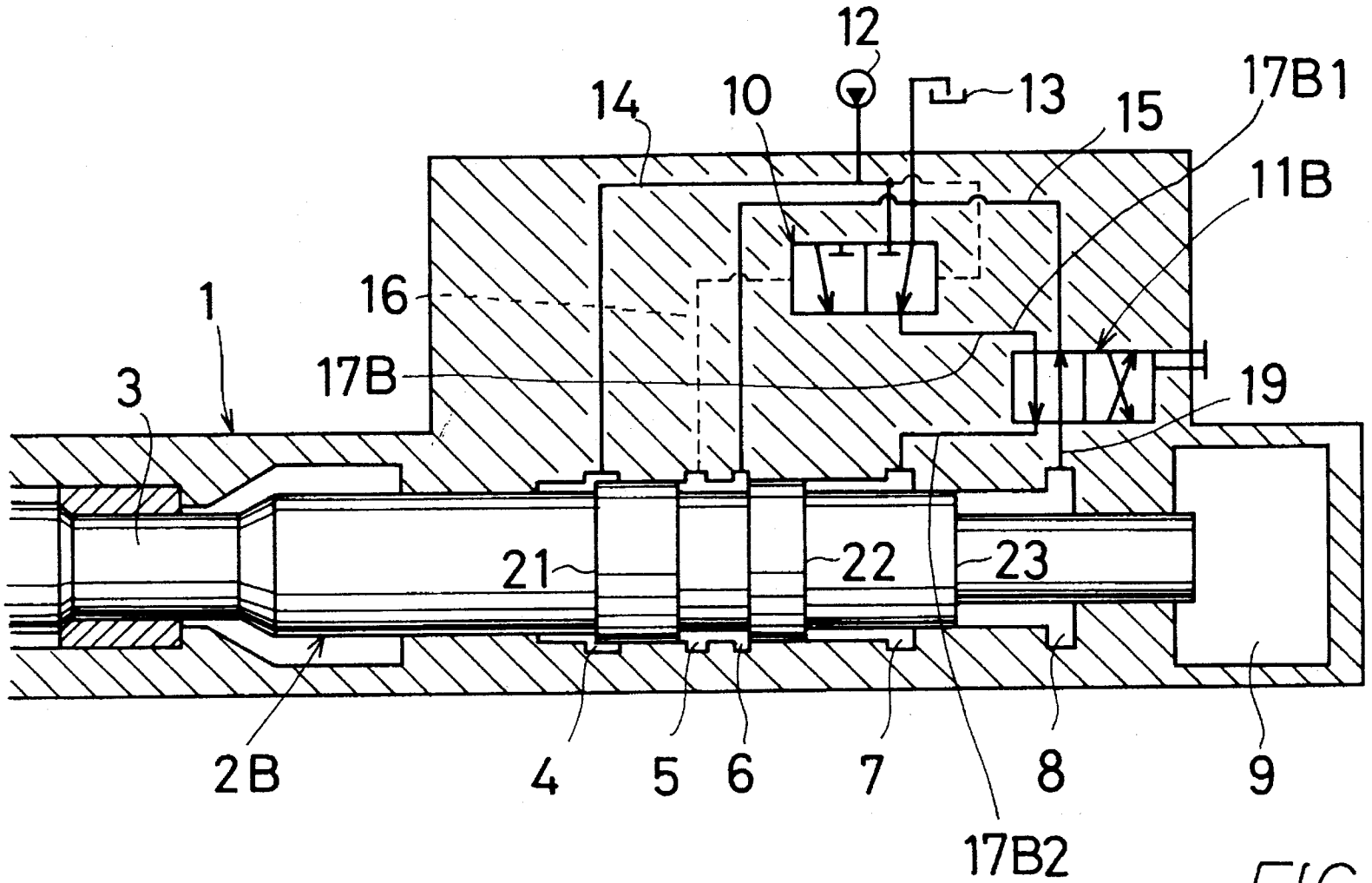
FIG. 7 is a vertical sectional view of the essential portions of an impact device according to a fourth embodiment of the present invention.

At position A3, the directional control valve 11B opens the first inverting-pressure conduit 17B and permits communication between the change-over conduit 19 and the low-pressure conduit 15 as shown in FIG.7.

At position B3, the directional control valve 11B connects the lower-pressure conduit 15 to a conduit part 17B2 of the first inverting-pressure conduit 17B on the side of the first inverting-pressure chamber 7 and connects the change-over conduit 19 to a conduit part 17B1 of the first inverting-pressure conduit 17B on the side of the directional control valve 10.

With this embodiment, when the directional control valve 10 is switched to position A1 on the condition that the directional control valve 11B is switched to position A3, the pressurized hydraulic fluid supplied from the directional control valve 10 is transmitted to the first inverting-pressure chamber 7 while the second inverting-pressure chamber 8 is kept at low pressure. Thus, the pressure of the pressurized hydraulic fluid is applied to the second pressure-receiving surface 22 but is not applied to the additional pressure-receiving surface 23.

On the other hand, when the directional control valve 10 is switched to position A1 on the condition that the directional control valve 11B is switched to position B3, the pressurized hydraulic fluid is transmitted to the second inverting-pressure chamber 8 while the first inverting-pressure chamber 7 is kept at low pressure. Thus, the pressure of the pressurized hydraulic fluid is applied to the additional pressure-receiving surface 23 but is not applied to the second pressure-receiving surface 22.

The application of the pressurized hydraulic fluid to the additional pressure-receiving surface 23 results in greater consumption of the hydraulic fluid than that required in the application to the second pressure-receiving surface 22, so that a larger impact force can be obtained.

The fifth embodiment of the present invention will now be explained with reference to FIGS. 8 and 9. The impact device of this embodiment is applied to a hydraulic breaker in which a plunger normally receives higher pressure in the direction toward its forward stroke end. A cylinder 1C forms, between its inner wall and a plunger 2C, a high-pressure chamber 4C, a pilot chamber 5C, a low-pressure chamber 6C, a first inverting-pressure chamber 7C and a second inverting-pressure chamber 8C which are in turn positioned in the forward direction. An accumulator 31 is connected in the midway of a high-pressure conduit 14C which is connected to the high-pressure chamber 4C. The low-pressure conduit 15C is connected to the reservoir tank 13.

The plunger 2C is formed with a first pressure-receiving surface 21C, a second pressure-receiving surface 22C and an additional pressure-receiving surface 23C which are in turn positioned in the forward direction.

The lower pressure conduit 15C connects the lower-pressure chamber 6C to a reservoir port of a directional control valve 10C and to a reservoir port of a directional control valve 11C. A first inverting-pressure conduit 17C connects the first inverting-pressure chamber 7C to a cylinder port C the directional control valve 10C. A second inverting-pressure conduit 18C connects the first inverting-pressure conduit 17C to a pump port of the directional control valve 11C. A change-over conduit 19C is connected between the second-inverting pressure chamber 8C and a cylinder port of the directional control valve 11C.

Figure 8:
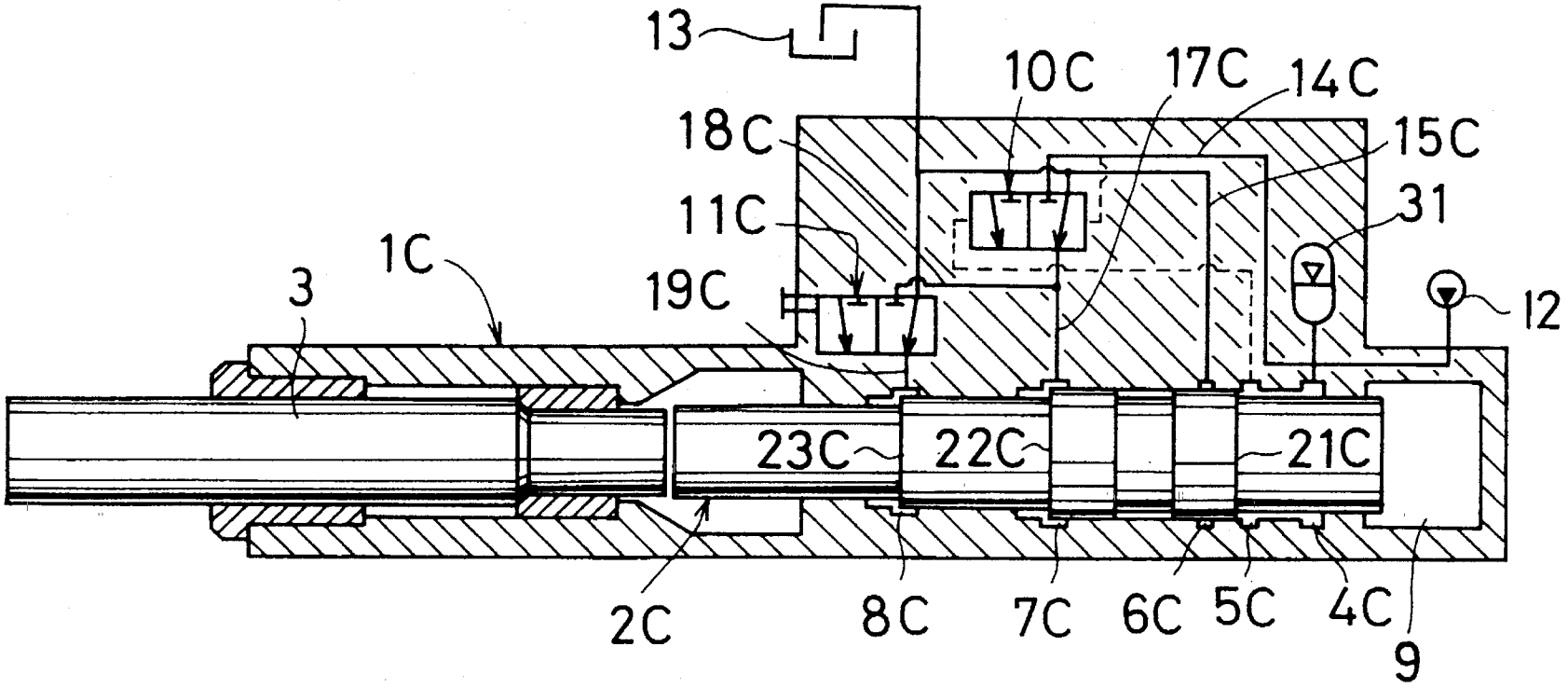
FIG. 8 is a vertical sectional view of an impact device according to a fifth embodiment of the present invention.

When the hydraulic pump 12 is driven to supply the pressurized hydraulic fluid to the high-pressure conduit 14C on the condition that the directional control valve 11C is switched to position B5 as shown in FIG. 8, the directional control valve 10C is switched from position B4 shown in FIG. 8 to position A4 (the position shown in FIG. 9) so as to supply the pressurized hydraulic fluid to the inverting-pressure chamber 7. Here, the pressurized hydraulic fluid is normally supplied from the hydraulic pump 12 to also the high-pressure chamber 4C. However, the pressure-receiving surfaces 21C and 22C are determined to have different areas, so that the plunger 2C moves rearwardly.

When the plunger 2C reaches its rear stroke end, the pilot chamber 5C is disconnected from the high-pressure chamber 4C, so that the directional control valve 10C is switched to return position B4 where the first inverting-pressure chamber 17C is connected to the low-pressure conduit 15C. Thus, the pressure within the first inverting-pressure chamber 17C is lowered, and therefore, the plunger 2C is moved forwardly.

When the plunger 2C reaches its forward stroke end, the pilot chamber 5C is brought to communicate with the high-pressure chamber 4C, so that the directional control valve 10C is switched to position A4. Then, the first inverting-pressure chamber 4C is brought to communicate with the high-pressure conduit 14C, so that the second pressure-receiving surface 22C receives higher pressure from the hydraulic fluid to move the plunger 2C rearwardly as described above.

Figure 9:
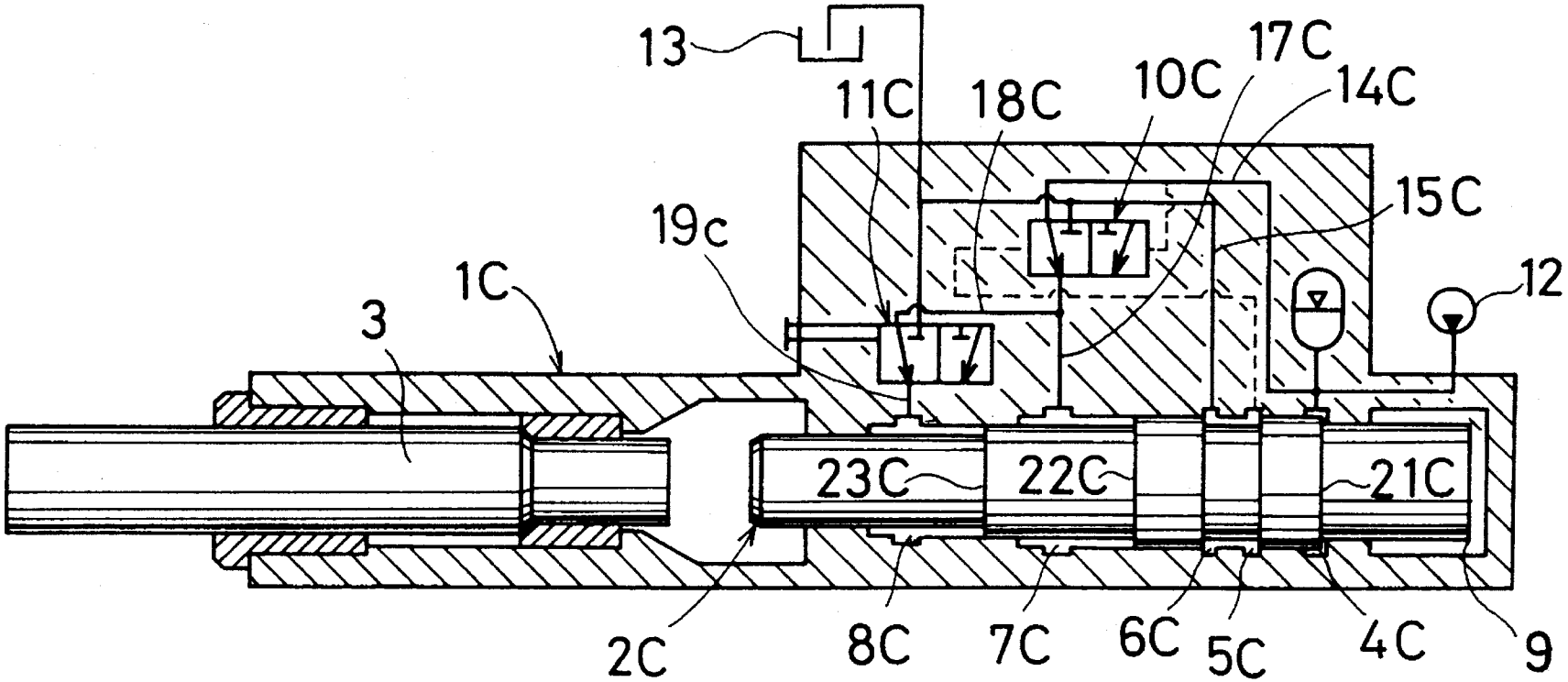
FIG. 9 is a view similar to FIG. 8 but showing the operation when the plunger is moved rearwardly.

On the other hand, when the directional control valve 11C is switched to position A5 as shown in FIG. 9 where the change-over conduit 19C is brought to communicate with the second inverting-pressure conduit 18C, the pressurized hydraulic fluid supplied from the directional control valve 10C to the first inverting-pressure chamber 7C is also supplied to the second inverting-pressure chamber 8C, so that plunger 2C is moved rearwardly to return to the rearward stroke end by the force applied to the additional pressure-receiving surface 23C in addition to the force applied to the first pressure-receiving surface 22C. Here, a gas of high pressure is sealingly contained in the sealed gas chamber 9, so that the impact force applied to the plunger 2C can be increased.

The sixth embodiment of the present invention will now be described with reference to FIG. 10. The construction of this embodiment is substantially the same as that of the fourth embodiment shown in FIG. 7, excepting the incorporation of a directional control valve 11D of four-port/three-position type in place of the directional control valve 11B. A first inverting-pressure conduit 17D corresponds to the first inverting-pressure conduit 17B and includes two conduit parts 17D1 and 17D2 positioned on the side of the directional control valve 10 and on the side of the inverting-pressure chamber 7, respectively.

The directional control valve 11D is operable to be switched to either one of positions A6, B6 and C6 as will be hereinafter explained.

At position A6, the directional control valve 11D connects the conduit part 17D1 of the first inverting-pressure conduit 17D to the conduit part 17D2 as well as to the change-over conduit 19, while it prevents communication between the lower-pressure conduit 15 and the change-over conduit 19. Thus, the hydraulic fluid supplied from the directional control valve 10 is transmitted to both the first and second inverting-pressure chambers 7 and 8. The additional pressure-receiving surface 23 as well as the second pressure-receiving surface 22 therefore receives the pressure to forwardly move a plunger 2D received in a cylinder 1D for impact operation.

Figure 10:
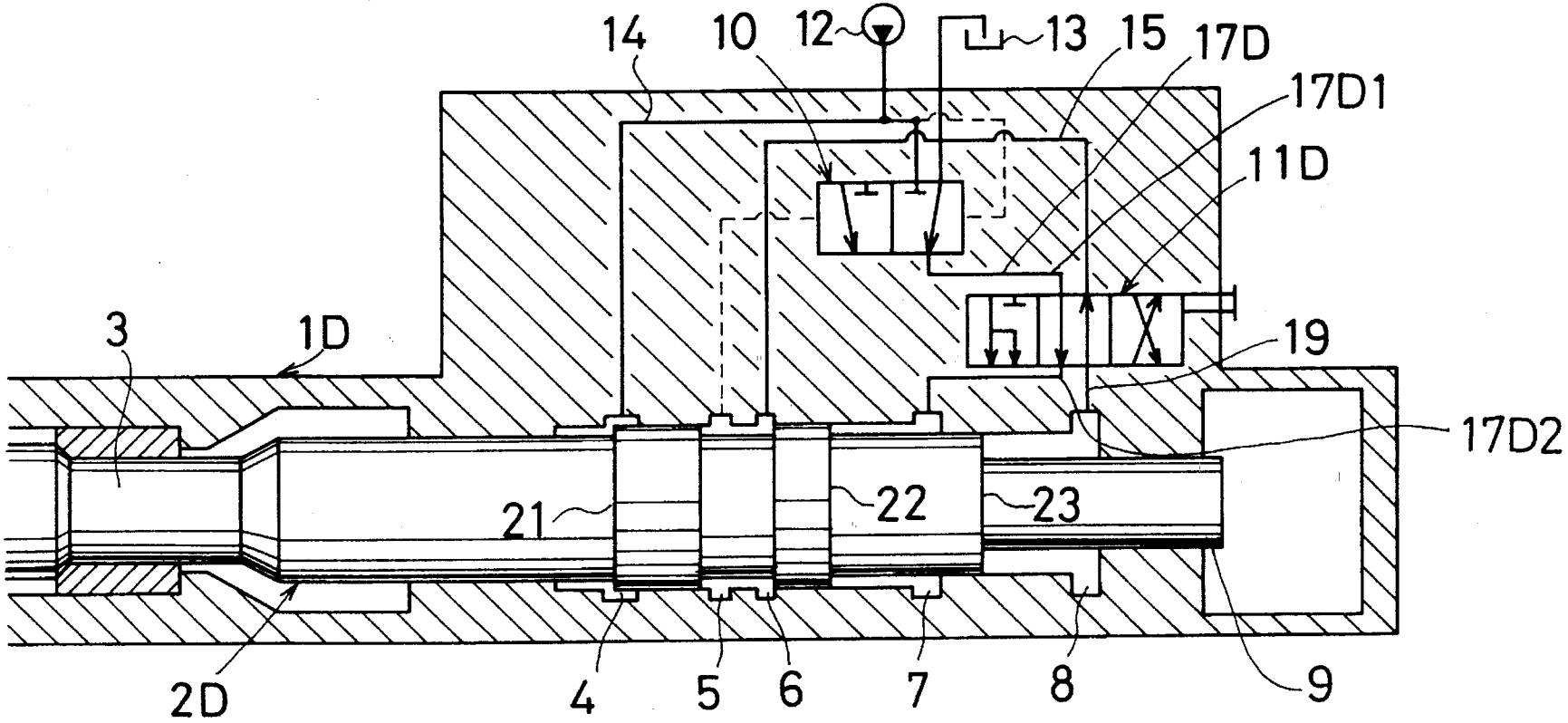
FIG. 10 is a vertical sectional view of the essential portions of an impact device according to a sixth embodiment of the present invention.

At position B6, the directional control valve 11D connects the conduit parts 17D1 and 17D2 to each other and connects the low-pressure conduit 15 to the change-over conduit 19 as shown in FIG. 10. Thus, in this case, the pressurized hydraulic fluid is supplied only to the first inverting-pressure chamber 7 for the forward movement of the plunger 2D.

At position C6, the directional control valve 11D connects the conduit part 17D1 of the first inverting-pressure conduit 17 to the change-over conduit 19 and connects the lower-pressure conduit 15 to the conduit part 17D2. Thus, in this case, the pressurized hydraulic fluid is supplied only to the second inverting-pressure chamber 8 for the forward movement of the plunger 2D.

Figure 11A:
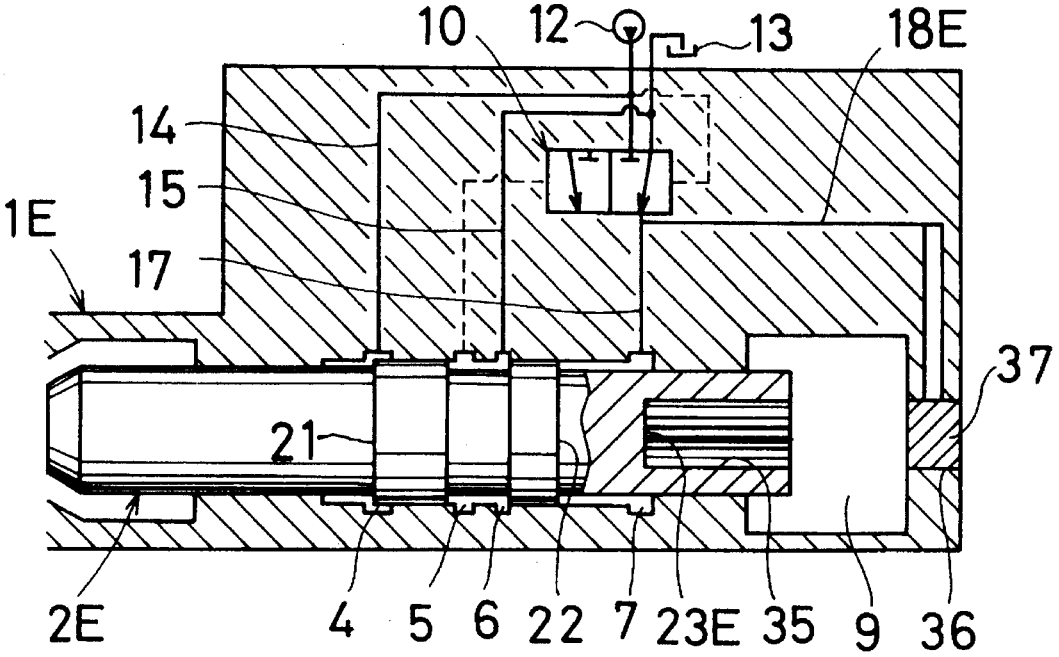
FIG. 11(A) is a vertical sectional view of the essential portions of an impact device according to a seventh embodiment of the present invention.
Figure 11B:
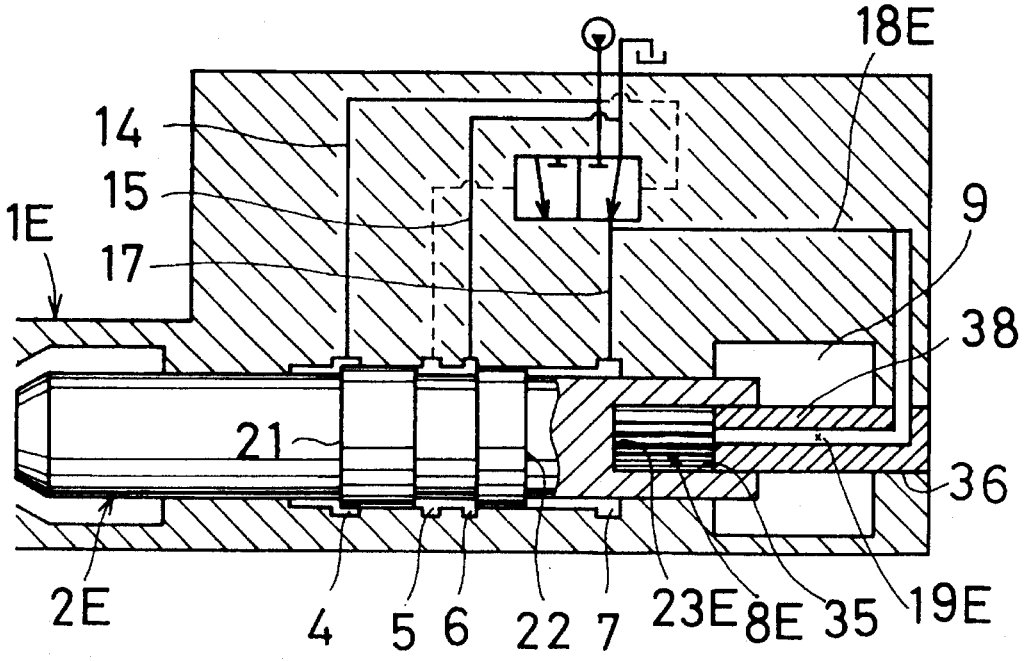
FIG. 11(B) is a view similar to FIG. 11(A) but showing a different operation.

The seventh embodiment of the present invention will now be described with reference to FIGS. 11(A) and 11(B).

In this embodiment, a plunger 2E is received within a cylinder 1E and includes the first and second pressure-receiving surfaces 21 and 22 as with the first embodiment. The plunger 2E includes, at its rear end, a cylindrical bore 35 formed coaxially with the plunger 2E and opened in the rearward direction. An additional pressure-receiving surface 23E is formed on the bottom of the cylindrical bore 35.

Further, a through hole 36 is formed on the rear wall of the cylinder 1E and is positioned on the same axis as the bore 35. The through hole 36 has one end opened to the sealed gas chamber 9 and has the other end opened to outside. A second inverting-pressure conduit 18E has one end connected to the cylinder port of the directional control valve 10 and has the other end opened to the through hole 36 at its inner wall.

A blank cap like first change-over member 37 and a second change-over member 38 are selectively detachably inserted into the through hole 36 of the cylinder 1E. The first change-over member 37 has a configuration corresponding to the through hole 36 and serves to close the sealed gas chamber 9 from the outside and to close the opened end of the second inverting-pressure conduit 18E as shown in FIG. 11(A) when it is inserted into the through hole 36. The second change-over member 38 has a length longer than the length of the through hole 37. When the second change-over member 38 is inserted into the through hole 36, its forward end extends forwardly across the sealed gas chamber 9 and is inserted into the bore 35 of the plunger 2E so as to define a second inverting-pressure chamber 8E as shown in FIG. 11(B). A change-over conduit 19E is formed within the second change-over member 38 in the longitudinal direction. The change-over conduit 19E has a forward end opened at the forward end surface of the second change-over member 38 for connection with the second inverting-pressure chamber 8E. A rear end of the change-over conduit 19E has an L-shaped configuration and is opened at the lateral surface of the second change-over member 38 positioned within the through hole 37 so as to be connected to the opened end of the second-inverting pressure conduit 18E.

When the first change-over member 37 is inserted into the through hole 36, the second inverting-pressure conduit 18E is closed, so that the pressurized hydraulic fluid may not be applied to the additional pressure-receiving surface 23E. Thus, the pressurized hydraulic fluid for forward movement of the plunger 2E is supplied only to the first inverting-pressure chamber 7 so as to apply force to the second pressure-receiving surface 22.

When the second change-over member 38 is inserted into the through hole 36, the second inverting-pressure conduit 18E is connected to the second inverting-pressure chamber 8E through the change-over conduit 19E, so that the pressurized hydraulic fluid for forward movement of the plunger 2E is supplied to the second inverting-pressure chamber 8E as well as to the first inverting-pressure chamber 7 so as to apply force to both the second pressure-receiving surface 22 and the additional pressure-receiving surface 23E.

The eighth embodiment of the present invention will now be described with reference to FIGS. 12(A) and 12(B). In this embodiment, a second inverting-pressure conduit 18F has one end connected to the midway of a first inverting-pressure conduit 17F which connects the first inverting-pressure chamber 8 to the cylinder port of the directional control valve 10 as with the first embodiment. The second inverting-pressure conduit 18F has the other end opened to the outside of a cylinder 1F and includes a smaller-diameter conduit part 40, an intermediate-diameter conduit part 41, a larger-diameter conduit part 42 and a bore part 43 in turn positioned in the direction away from the first inverting-pressure conduit 17F. A change-over conduit 19F connects the second inverting pressure chamber 8 to the midway of the intermediate-diameter conduit part 41 of the second inverting-pressure conduit 18F.

Figure 12A:
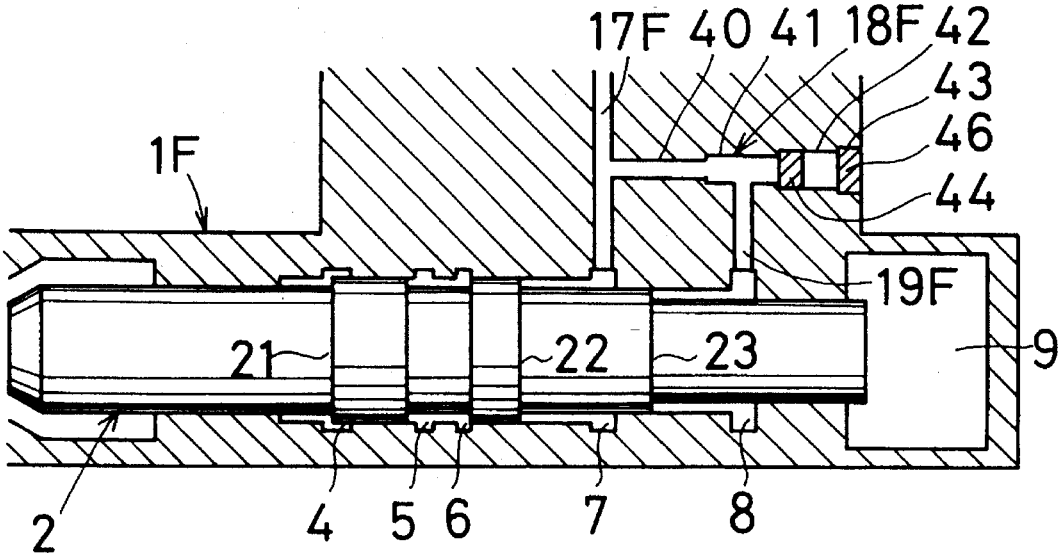
FIG. 12(A) is a vertical sectional view of the essential portions of an impact device according to a eighth embodiment of the present invention.

In order to permit the pressurized hydraulic fluid to be supplied to both the first inverting-pressure chamber 7 and the second inverting-pressure chamber 8 for forward movement of the plunger 2, a first detachable blind plug 44 having the same diameter as the larger-diameter conduit part 42 is inserted into the second inverting-pressure conduit 18F as shown in FIG. 12(A), so that the first plug 44 is stopped at the forward end of the larger-diameter conduit part 42 and closes the larger-diameter conduit part 42. Thus, the first inverting-pressure conduit 18F is closed from the outside and keeps the first inverting-pressure conduit 17F in communication with the second inverting-pressure chamber 8. Therefore, the pressurized hydraulic fluid can be supplied from the first inverting-pressure conduit 17F to the first inverting-pressure chamber 7 and also to the second inverting-pressure chamber 8 via the second inverting-pressure conduit 18F. In this case, a second detachable blind plug 46 is inserted into the bore part 43 so as to close the rear end of the second inverting-pressure conduit 18F.

Figure 12B:
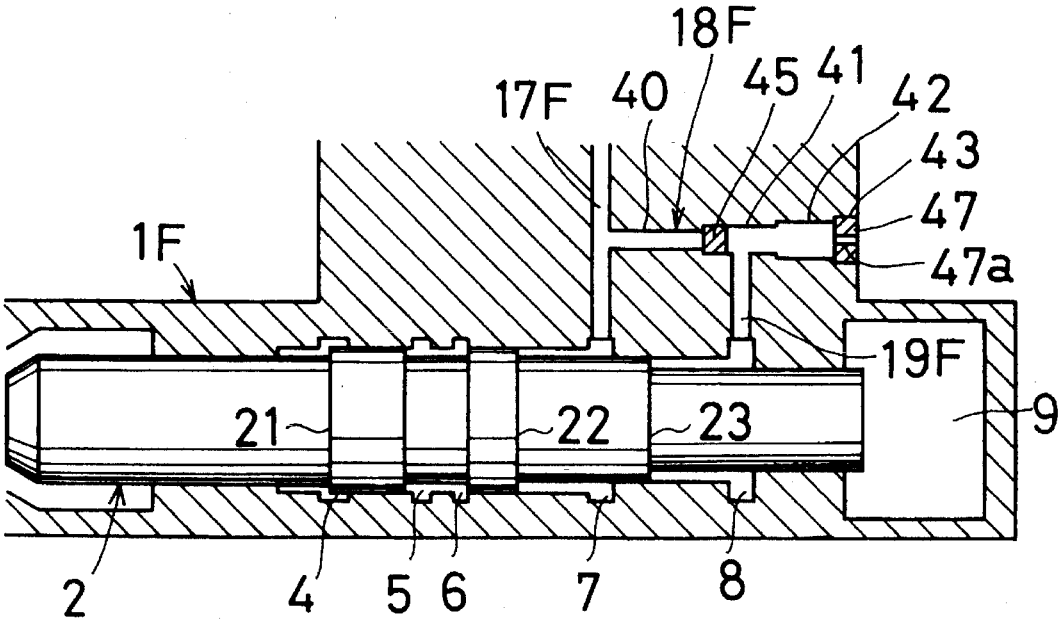
FIG. 12(B) is a view similar to FIG. 11(A) but showing a different operation.

In order to permit the pressurized hydraulic fluid to be supplied to only the first inverting-pressure chamber 7, a third detachable blind plug 45 having the same diameter as the intermediate-diameter part 41 is inserted into the second inverting-pressure conduit 18F as shown in FIG. 12(B), so that the third plug 45 is stopped at the forward end of the intermediate-diameter conduit part 41 and prevents the hydraulic fluid from being supplied from the first inverting-pressure conduit 17F to the change-over conduit 19F. In this case, a fourth detachable plug 47 is inserted into the bore part 43. The fourth plug 47 has a through hole **47*a* extending in an axial direction so as to permit communication between the second inverting-pressure chamber 8 and the outside. Alternatively, the large-diameter conduit part 42 of the second inverting-pressure conduit 18F and the sealed gas chamber 9 may be connected by an air conduit (not shown), with the bore part 43 closed by the second blind plug 46 and with the third plug 45 inserted into the intermediate-diameter conduit part 41, so that the air within the change-over conduit 19F can flow into the sealed gas chamber 9 when the plunger 2** is moved rearwardly.

While the invention has been described with reference to preferred embodiments, it is to be understood that modifications or variation may be easily made without departing from the spirit of this invention which is defined by the appended claims.

What is claimed is:

1. An impact device comprising:

a cylinder;

a plunger received within said cylinder and movable forwardly and rearwardly in an axial direction of said cylinder, said plunger having a first pressure receiving surface and a second pressure receiving surface for receiving pressure of a pressurized fluid so as to apply force to said plunger in opposite forward and rearward axial directions, respectively, said plunger having an additional pressure receiving surface for receiving the pressure from the pressurized fluid so as to apply force in the same direction as said first pressure receiving surface;

first control means for automatically controlling the pressurized fluid applied to at least one of said first and second pressure receiving surfaces in response to a position of said plunger in the axial direction of said cylinder so as to reciprocally move said plunger in the axial direction; and second control means associated with said first control means and controlling the supply of the pressurized fluid to be applied on said additional pressure receiving surface in two different control modes including a first control mode and a second control mode, said second control means in said first control mode being operable to supply and to stop the supply of the pressurized fluid to said additional pressure receiving surface at the same time as the pressurized fluid is supplied and is stopped to be supplied to said first pressure receiving surface, respectively, and said second control means in said second control mode being operable to stop the supply of the pressurized fluid to said additional pressure receiving surface irrespective of the operation of said first control means.

2. The impact device as defined in claim 1, wherein said cylinder includes a first chamber, a second chamber and an additional chamber which are formed between an inner wall of said cylinder and said plunger and which serve to receive the pressurized fluid for applying pressure to said first pressure receiving surface, said second pressure receiving surface and said additional pressure receiving surface, respectively.

3. The impact device as defined in claim 2 wherein the fluid is a hydraulic fluid, wherein said first control means is operable to connect said additional pressure receiving chamber to a reservoir tank of the fluid via a low pressure conduit when said pressurized fluid is not to be supplied to said additional pressure receiving chamber, and wherein an accumulator is provided in said low pressure conduit.

4. The impact device as defined in claim 2 wherein said plunger includes a bore formed on its rear end in said axial direction, wherein said additional pressure receiving chamber is defined by said bore, and wherein said additional pressure receiving surface is formed on a bottom of said bore.

5. The impact device as defined in claim 2, wherein said first control means includes a first flow control valve for controlling the supply of pressurized fluid to said first chamber and said second chamber, and wherein said second control means further comprises a second flow control valve for controlling the supply of pressurized fluid to said additional chamber.

6. The impact device as defined in claim 2, wherein said second control means includes a first plug and a second plug which are selectively removably inserted into a flow channel connecting said first control means and said additional chamber to each other, wherein said first control means is operable to supply the pressurized fluid to said flow channel when said first control means is operated to supply the pressurized fluid to said first chamber, wherein said first plug is operable to permit the pressurized fluid to flow from said flow channel to said additional chamber so as to provide said first control mode, and wherein said second plug is operable to prevent the pressurized fluid from flowing from said flow channel to said additional chamber so as to provide said second control mode.

7. The impact device as defined in claim 2, further including a pilot chamber formed between said plunger and said inner wall of said cylinder, wherein said pilot chamber has a pressure varying in response to the position of said plunger, and said first control means is connected to said pilot chamber for controlling the supply of at least one of the pressurized fluid applied to said first pressure receiving surface and the pressurized fluid applied to said second pressure receiving surface in response to the pressure in said pilot chamber.

8. The impact device as defined in claim 7, wherein the pressure of said pilot chamber is varied when said plunger reaches its forward and rearward stroke ends, respectively.

9. The impact device as defined in claim 7, wherein said first pressure receiving surface has an area greater than an area of said second pressure receiving surface, wherein the pressurized fluid is normally applied to said second pressure receiving surface, wherein said first control means controls the supply of the pressurized fluid applied to said first pressure receiving surface, so that said plunger is moved axially in opposite directions when the pressurized fluid is supplied and is stopped to be supplied to said first pressure receiving surface, respectively.

10. The impact device as defined in claim 9, further comprising a low pressure chamber formed between said plunger and said inner wall of said cylinder and connected to a reservoir tank of the pressurized fluid, and wherein said pilot chamber is connected to one of said first chamber and said second chamber for receiving the supply of the pressurized fluid when said plunger reaches one of said forward and rearward stroke ends, and wherein said pilot chamber is connected to said low pressure chamber when said plunger reaches the other of said forward and rearward stroke ends.

* * * * *